US010183783B2

(12) United States Patent
Donner

(10) Patent No.: US 10,183,783 B2
(45) Date of Patent: Jan. 22, 2019

(54) CARRIER BAG WITH LOOPS AND DISPLACED RIMS

(71) Applicant: Papier-Mettler KG, Morbach (DE)

(72) Inventor: Georg Donner, Morbach (DE)

(73) Assignee: Papier-Mettler KG, Morbach (DE)

( * ) Notice: Subject to any disclaimer, the term of this patent is extended or adjusted under 35 U.S.C. 154(b) by 685 days.

(21) Appl. No.: 14/792,195

(22) Filed: Jul. 6, 2015

(65) Prior Publication Data

US 2017/0008676 A1 Jan. 12, 2017

(51) Int. Cl.

| | |
|---|---|
| ***B65D 33/06*** | (2006.01) |
| ***B65D 33/10*** | (2006.01) |
| ***B65D 33/00*** | (2006.01) |
| ***B65D 30/20*** | (2006.01) |
| *A47F 13/08* | (2006.01) |

(52) U.S. Cl.

CPC ..... *B65D 33/105* (2013.01); *B65D 31/10* (2013.01); *B65D 33/001* (2013.01); *B65D 33/007* (2013.01); *A47F 13/085* (2013.01)

(58) Field of Classification Search

CPC .... B65D 33/105; B65D 31/10; B65D 33/001; B65D 33/007

USPC .... 383/6, 14, 15, 20, 22, 24, 26, 27, 30, 31, 383/37

See application file for complete search history.

(56) References Cited

U.S. PATENT DOCUMENTS 3,985,291 A * 10/1976 Benzon-Petersen .... B65B 43/14 206/554

4,676,378 A 6/1987 Baxley et al.

(Continued)

FOREIGN PATENT DOCUMENTS

AU 57159/73 * 1/1975
JP 2000085790 A * 3/2000

*Primary Examiner* — Jes F Pascua

(74) *Attorney, Agent, or Firm* — Seed Intellectual Property Law Group LLP

(57) ABSTRACT

A carrier bag has a first side panel (back panel) with a first carrier handle, which may be a first flexible loop, and an opposing second side panel (front panel) with a second carrier handle, which may be a second flexible loop. The first side panel has a first upper edge and a first lower edge as well as two opposite first side edges, wherein the second side panel has a second upper edge and a second lower edge as well as two opposite second side edges. The first and second side panels are connected to each other at or adjacent to the respective first and second side edges to form lateral sides of the bag, or the first and second side panels are connected at the first and second side edges to opposing lateral walls to form lateral sides of the bag. A bottom of the bag is formed by a bottom wall that is connected to the first and second lower edges or by a weld seam or glue seam that joins the first and second lower edges. An opening is formed between the first and second upper edges, wherein the first upper edge has a first distance from the first lower edge and the second upper edge has a second distance from the second lower edge, wherein the first distance is smaller than the second distance. The first upper edge is displaced by a third distance from the second upper edge. Furthermore, the disclosure relates to a rack of bags comprising such carrier bags as well as a method for producing carrier bags and a process of serially dispensing and opening carrier bags.

22 Claims, 5 Drawing Sheets

(56) References Cited

U.S. PATENT DOCUMENTS

| | | | | |
|---|---|---|---|---|
| 5,141,336 | A * | 8/1992 | Sander | A45C 3/04 383/27 |
| 6,171,226 | B1 | 1/2001 | DeMatteis | |
| 8,322,923 | B2 * | 12/2012 | Gum | B65D 33/10 383/120 |
| 2002/0112982 | A1 * | 8/2002 | Stagray | B65D 75/56 206/494 |
| 2006/0013513 | A1 * | 1/2006 | Meyer | B65D 33/105 383/25 |

* cited by examiner

CARRIER BAG WITH LOOPS AND DISPLACED RIMS

BACKGROUND

Technical Field

The present disclosure relates to a carrier bag with loops for containing merchandise, in particular food, that allows for a rapid opening and filling of the bag. The present disclosure also relates to a method of manufacture for bags as well as a process of filling such bags with items.

Description of the Related Art

Carrier bags are regularly used as shopping bags. In some shops, said bags are opened and filled with items by a customer, whereas in other shops said bags are filled by employees. In particular, in food stores/supermarkets, said items are regularly inserted into the bag by customers. The separation, opening and subsequent insertion of articles into the bags is a time consuming step that significantly increases checkout throughput times. Thus, in some shops, one employee is responsible for any payment at the cash desk and a second employee takes over the task of handling articles. Also, if customers are filling said bags on their own (which is generally preferred), said checkout times are increased significantly. The problem of providing a method to increase the speed of removing a bag from a stack of bags and subsequent filling of said bag has been known for a long time.

U.S. Pat. No. 6,171,226 relates to a process for serially dispensing and opening of bags from a bundle of bags. A leading bag with a carrying handle made from a die-cut hole is attached to the trailing bags. Pulling on the first bag leads to a severance of this attachment and helps in opening the bag.

U.S. Pat. No. 4,676,378 relates to a bag pack with multiple stacked T-shirt bags that can be easily drawn from a rack mounted pack. This is achieved using a readily severable adhesive engagement between the bags that retains the rear wall while the front wall of the bag is drawn forward.

Many conventional systems of providing bags make use of comparatively low-quality bags with carrier handles that are die-cut holes near the top of the bag or formed by T-shirt bags. Said carrier handles are not as tear-resistant as carrier bags having a separate carrier handle attached to the bag body. It should be noted that customers expect high-quality, tear resistant carrier bags in connection with the selling of food in food stores/supermarkets. If said bags are not sufficiently tear resistant, there is a significant danger that contents may be spilled if said bags are loaded with heavy items, such as dairy products or beverages.

Additionally, solutions are often proposed wherein the bags are attached to each other. The fastening means that are used can cause a tearing of the bags and affect the outward appearance disadvantageously. Furthermore, it is a known problem that carrier bags that comprise handles made of a flexible loop attached to the bag cannot be stacked in the same manner as bags having handles that are die-cut holes. These solutions for separation of bags cannot be applied to carrier bags that have a separate carrier handle, e.g., made of a flexible loop.

There is a need for high-quality, tear resistant bags that speed up checkout throughput times. In particular, there is need for bags that facilitate separation from a stack of bags and filling of said bags with articles. A further object is to provide a method for the efficient manufacture of such bags. Furthermore, another object is to provide a process for filling such a bag.

Further objects and advantages of the present disclosure will become apparent as the description proceeds.

BRIEF SUMMARY

Disclosed is a carrier bag having a first side panel with a first carrier handle and an opposing second side panel with a second carrier handle. In various embodiments, the first carrier handle and/or the second carrier handle may be a flexible loop. The first side panel has a first upper edge and a first lower edge as well as two opposing first side edges. The second side panel has a second upper edge and a second lower edge as well as two opposing second side edges. The first and second side panels are connected to each other at or adjacent to corresponding first and second side edges to form lateral sides of the bag, or the first and second side panels are connected by opposing lateral walls at corresponding first and second side edges to form lateral sides of the bag. A bottom of the bag is formed by a bottom wall that is connected to the first and second lower edges, or the bottom is formed by a weld seam or glue seam that joins the first and second lower edges. An opening is formed between the first and second upper edges, wherein the first upper edge has a first distance from the first lower edge, and the second upper edge has a second distance from the second lower edge. It is significant that the first distance is smaller than the second distance and that the first upper edge is displaced by a third distance from the second upper edge. As the second upper edge is higher (further away from its second lower edge) than the first upper edge, grabbing of the second side panel is facilitated. The carrier bag may be easily separated from a stack of such bags.

"Adjacent" to the first and second side edges preferably should be understood to be less than 3 cm spaced, in particular less than 2.5 cm, apart from said side edges. It should be noted that a weld seam or glue seam can join the first and second side panels adjacent to corresponding first and second edges if it is slightly spaced apart from said side edges. Preferably corresponding edges in carrier bags of the present disclosure are joined by weld seams or glue seams that have a distance of less than 2.0 cm (0.79 inch), in particular less than 1.5 cm (0.59 inch), preferably less than 1.0 cm (0.39 inch) and in particular preferred less than 0.8 cm (0.31) from the actual side edges. Due to the fact that the corresponding weld seams or glue seams are placed very close to the opposing edges, said edges superimpose each other permanently and thus are considered to be connected. This procedure of joining edges is well known to a person skilled in the art. It is also possible to join said edges using other methods as are known to a person skilled in the art. In various embodiments of carrier bags described herein, the third distance equals the difference between the first and second distance.

In an advantageous embodiment of the carrier bag, the first and second side panels are connected to each other at or adjacent to the first and second side edges, in particular by first and second weld seams or glue seams on each side panel, to form lateral sides of the bag, and a bottom of the bag is formed by a bottom wall that is connected to the first and second lower edges. It is particularly advantageous if said bottom wall is foldable. Carrier bags of this type are particularly preferred if the first and second side panels are connected to each other at or adjacent to the first and second side edges to form lateral sides of the bag by first and second weld seams or glue seams, wherein the first and second weld seams or glue seams also connect the bottom wall with the first and second side panels. The bottom wall preferably comprises a third V-shaped fold and in particular forms a W-Shaped fold in combination with the first and second side panels. Bags of this type have a large interior space due to a (foldable) bottom wall and additionally are comparatively easy to manufacture as the sides are connected directly without the need for lateral walls attached to the side panels. Surprisingly, the separation of the first and second side panels using the first and second upper edges works well with this type of bags even if first and second weld seams or glue seams connect the first and second panel adjacent to the opening directly resulting in a close arrangement of the first upper edge to the second side panel.

In a further embodiment, the first upper edge is formed by a first V-shaped fold, wherein one thigh of the first V-shaped fold is formed by the first side panel whereas the other thigh is formed by a first foil strip, in particular a first foil strip that is connected to the first side panel using a third weld seam or glue seam spaced at a distance from the first V-shaped fold that is facing the second side panel and/or wherein the second upper edge is formed by a second V-shaped fold, wherein one thigh of the second V-shaped fold is formed by the second side panel whereas the other thigh is formed by a second foil strip, in particular a second foil strip that is connected to the second side panel using a fourth weld seam or glue seam spaced at a distance from the second V-shaped fold that is facing the first side panel. The distance between the respective V-shaped fold (i.e., the first and second V-shaped fold/upper edge) and the respective weld seams or glue seams (third and fourth weld seams or glue seams), which preferably runs parallel to the line of folding of the V-shaped fold, measures preferably in each case at least 1 cm (0.39 inch), in particular at least 2 cm (0.79 inch) and in particular advantageous embodiments at least 4 cm (1.57 inch). The third and fourth weld seams or glue seams that are spaced at a distance from the respective line of folding (first and second upper edges) provide a high stability to the rim adjacent to the opening of the bags. This is important if a user is to grab a single rim corresponding to the second upper edge, thus increasing the strain on said single rim. If both rims are grabbed simultaneously, the strain is less.

In at least one advantageous embodiment of the carrier bag, the first flexible loop is connected to the first foil strip and the second flexible loop is connected to the second foil strip, for example using first and second welding or gluing areas. Preferably, the first and second welding or gluing areas also connect the first foil strip to the first side panel and the second foil strip to the second side panel. The first welding or gluing areas connect the first flexible loops on both ends and the second welding or gluing areas connect the second flexible loops on both ends. On each end of the first flexible loop there may be more than one first welding or gluing area. Similarly on each end of the second flexible loop there may be more than one second welding or gluing area. It is particularly preferred if at least two or three first welding or gluing areas are on each end of the first loop and at least two or three second welding or gluing areas are on each end of the second loop. If the first flexible loop is simultaneously connected by first welding or gluing areas to the first foil strip as well as the first side panel the support for said flexible loop is particularly strong, resulting in an especially tear resistant design of the loop. The same can be achieved for the second loop using a corresponding arrangement.

In a further design of a carrier bag according to the disclosure, the first carrier handle is attached by first fastening means comprised of first welding or gluing areas and the second carrier handle is attached by second fastening means comprised of second welding or gluing areas. Preferably, the first carrier handle is attached by at least four first fastening means, in particular at least four first welding or gluing areas, to the first side panel and the second carrier handle is attached by at least four second fastening means, in particular at least four second welding or gluing areas, to the second side panel. It may be particularly advantageous to use at least six first and second welding or gluing areas for the respective carrier handles. Using more than one fastening means enhances the tear resistance of each handle.

Carrier bags of this type are particularly preferred in which the at least two first fastening means are arranged opposing to the at least two second fastening means. The at least two first fastening means may be arranged at a fourth distance from the first lower edge and the least two second fastening means may be arranged at a fifth distance from the second lower edge, wherein the fourth distance is equal to the fifth distance. This design has proven to be particularly advantageous. In spite of the fact that the first and second upper edges have a different distance from their respective first and second lower edges, the fastening means for each carrier handle preferably has the same distance from the corresponding lower edge. This counterintuitive design avoids an unbalanced stronger strain on the first or second handle. Instead each handle experiences the same strain. Furthermore, attachment of the fastening means is simplified if first and second welding or gluing areas are used. In this case, said weld seams or glue seams can be attached in a single processing step.

In various embodiments, carrier bags according to the present disclosure have a first upper edge that is formed by a first V-shaped fold, wherein one thigh of the V-shaped fold is formed by the first side panel whereas the other thigh is formed by a first foil strip, in particular a first foil strip that is connected to the first side panel using a third weld seam or glue seam spaced at a distance from the first V-shaped fold that is facing the second side panel. The second upper edge is formed by a second V-shaped fold, wherein one thigh of the V-shaped fold is formed by the second side panel whereas the other thigh is formed by a second foil strip, in particular a second foil strip that is connected to the second side panel using a fourth weld seam or glue seam spaced at a distance from the second V-shaped fold that is facing the first side panel. A bottom of the bag is formed by a bottom wall that is connected to the first and second lower edges. The first side panel, second side panel, first foil strip, second foil strip and bottom wall are different sections of a continuous foil that is formed in one piece, wherein said sections are separated by folds, in particular wherein the first and second weld seam or glue seam each connect the first foil strip and the bottom wall to the first side panel as well as the second foil strip and the bottom wall to the second side panel.

The first and second side panels are preferably made from a first type of plastic foil and the first and second carrier handles are made from a second type of plastic foil. Furthermore, it may be particularly advantageous if the first and second carrier handles each are made of multiple layers of plastic foil, resulting in a multi-layered first and second composite carrier foil. Using different materials for the carrier handles and the side panels is advantageous, as properties can be adjusted according to the respective function. Tear resistance can be increased using a multi-layer design as described above.

In another embodiment according to the present disclosure, the first and second carrier handles each comprise at least two layers, wherein said layers comprise or are made from different thermoplastic polymers, in particular wherein the layers of each carrier handle that are facing each other have a higher average melting temperature than adjacent layers, wherein the melting temperature is determined according to DIN EN ISO 3146. It is preferred if the two layers of each carrier handle that are facing each are made of or comprise polypropylene whereas the adjacent layers preferably comprise or are made of polyethylene. Both carrier handles can be attached to the corresponding first and second side panels in a single welding step resulting in a facilitated manufacture of the carrier bag.

It has been found that an attachment of both carrier handles with welding areas by a single welding step without welding the carrier handles to each other is also possible if the first and second carrier handles, in particular on one side of the plastic foil of each carrier handle, are at least partially coated with lacquer in such a way that welding of the first to the second carrier handle in said coated areas is prevented. Surprisingly, different layers of thermoplastic polymers as described within the carrier handle are possible and may be beneficial, but are not necessary. Instead, e.g., a multi-layered first and second composite carrier foil can be used, wherein each layer may be of the same thermoplastic polymer. A welding of carrier handles to each other is prevented by the application of a lacquer that inhibits welding of areas that are coated with said lacquer. It is in particular preferred if the carrier handles are at least partially coated with lacquer in facing areas of the carrier handle. In a particularly beneficial embodiment according to the present disclosure, the ends of the first carrier handle are coated with lacquer on the side that faces opposing ends (end sections) of the second carrier handle which are preferably coated as well. It is preferred if said ends (end sections) are only coated on one side of the foil of the carrier handle. The ends of said first and second carrier handles thus are welded to the first and second side panel, however not to each other due to the coating. It is not necessary to fully coat the carrier handles on facing sides. The gripping section, in particular any sections of the carrier handles extending above the second upper edge, are in fact preferably not coated with lacquer. Thus a single welding step can be used to implement first and second welding areas without fusing the handles as well.

In various embodiments of carrier bags described herein, the first upper edge is formed by a first V-shaped fold, wherein one thigh of the V-shape is formed by the first side panel whereas the other thigh is formed by a first foil strip, in particular a first foil strip that is connected to the first side panel using a third weld seam or glue seam spaced at a distance from the first V-shaped fold that is facing the second side panel, and wherein the second upper edge is formed by a second V-shaped fold, wherein one thigh of the V-shape is formed by the second side panel whereas the other thigh is formed by a second foil strip, in particular a second foil strip that is connected to the second side panel using a fourth weld seam or glue seam spaced at a distance from the second V-shaped fold that is facing the first side panel. The first carrier handle is attached to the first foil strip at a sixth distance from the first upper edge and the second carrier handle is attached to the second foil strip at a seventh distance from the second upper edge, wherein the seventh distance is larger than the sixth distance.

In a further advantageous embodiment, the first carrier handle has a first total length and a first partial length, wherein the first partial length is the length that extends beyond the first upper edge away from the first lower edge, and the second carrier handle has a second total length and a second partial length, wherein the second partial length is the length that extends beyond the second upper edge away from the second lower edge. The first and second total lengths are equal and/or the first partial length is greater than the second partial length. The total length is the length of the respective carrier handle including end sections that are attached to the respective side panel. The above mentioned embodiment thus relates to carrier handles that have a different visible or free length. Surprisingly, this does not affect stability negatively. Instead it is ensured that the strain on each carrier handle is essentially the same. Thus tear resistance is enhanced due to an asymmetric design with respect to the first and second partial length.

It is particularly preferred if the difference in length between first and second partial length equals twice the third distance. Furthermore, it should be noted that if the present distance entities (e.g., a length and another length) are equal to each other, this is to be understood in such a way that said entities have the same value, albeit within the inaccuracy associated with the manufacture. A person skilled in the art will appreciate that an exact (mathematical) equality cannot be produced in reality as any value obtained by any method of production is only accurate within a certain uncertainty. Thus for two values not to be equal, they have to differ significantly.

In various embodiments, the first and second upper edge are spaced apart from each other at a third distance, wherein the third distance is at least 5 mm (0.20 inch), preferably 10 mm (0.39 inch). In a particular embodiment, the third distance is at least 15 mm (0.59 inch). It has been found that said difference in height is advantageous to allow for easy grabbing of the desired edge. Furthermore, said difference preferably should not exceed 5 cm (1.97 inch), in particular 3 cm (1.18 inch).

Carrier bags according to the disclosure are particularly preferred if the first upper edge is longer that the two first side edges. Preferably the two first side edges have the same length. It was found that the grabbing of the edge and the filling of the carrier bag is facilitated using this design.

The disclosure further relates to a rack of bags comprising bags as described within this disclosure, wherein the rack comprises at least one mount for bags and wherein said bags are not connected to each other, but placed adjacent to each other.

The disclosure further relates to a method for producing a carrier bag as described within this disclosure, having a first side panel (back panel) with a first carrier handle that is a first flexible loop and an opposing second side panel (front panel) with a second carrier handle comprised of a second flexible loop, wherein a first upper edge of the first side panel extends between the two first side edges at a first distance from a first lower edge of the first side panel, and a second upper edge of the second side panel extends between the two second side edges at a second distance from a second lower edge of the second side panel, wherein the first distance is smaller than the second distance and wherein the first upper edge is displaced by a third distance from the second upper edge. The method of producing said carrier bag comprises the following steps in this or a deviating order:

aligning the first and second side panels in such a way adjacent to each other that the first and second upper edges are arranged with a third distance from each other, inserting the first and second carrier handles between the first and second side panels, and welding the first carrier handle to the first side panel and the second carrier handle to the second side panel in a single welding step.

The disclosure also relates to a process of serially dispensing and opening a bag as described within this disclosure, from a stack of said bags, wherein each bag comprises, a first side panel (back panel) with a first carrier handle that is a first flexible loop and an opposing second side panel (front panel) with a second carrier handle comprised of a second flexible loop, wherein a first upper edge of the first side panel extends between the two first side edges at a first distance from a first lower edge of the first side panel and a second upper edge of the second side panel extends between the two second side edges at a second distance from a second lower edge of the second side panel, wherein the first distance is smaller than the second distance and wherein the first upper edge is displaced by a third distance from the second upper edge. The bags are arranged in a rack for bags having at least one mount for bags, wherein said bags are placed adjacent to each other and preferably not connected to each other, wherein the carrier handles preferably are arranged on said at least one mount, and wherein the process of serially dispensing and opening a bag comprises the following steps in this order:

grabbing the topmost bag at the second upper edge and pulling on said second upper edge, unfolding the topmost bag while the first upper edge is kept adjacent to the remaining stack of bags, inserting items into the topmost bag, and grabbing the topmost bag at the first and second upper edge and/or the first and second carrier handles in order to remove said bag from the remaining stack of bags.

BRIEF DESCRIPTION OF THE DRAWINGS

In the following description, the disclosure is explained in more detail by means of a preferred embodiment of the carrier bag relating to the enclosed drawings wherein.

DETAILED DESCRIPTION

Figure 1:
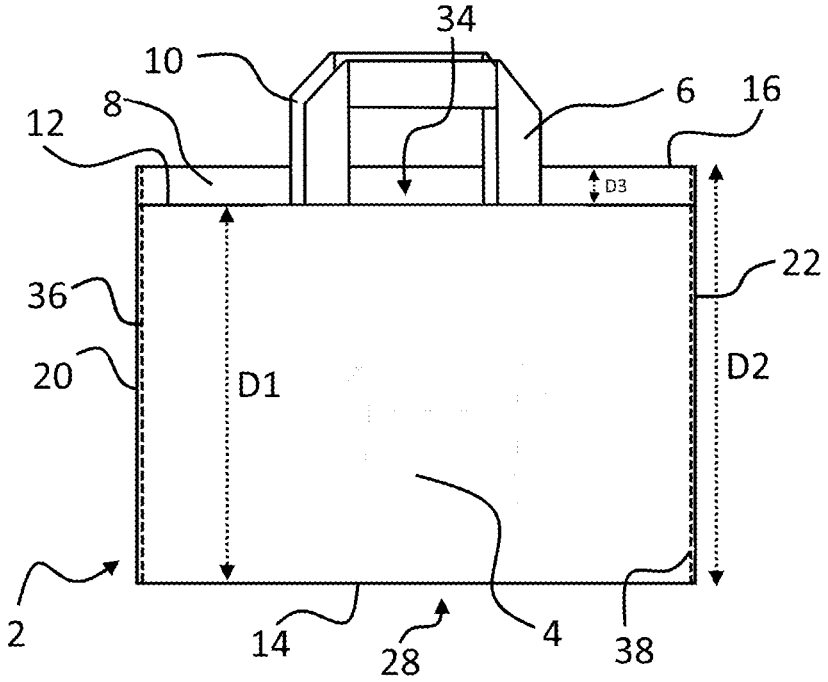
FIG. 1 is a plan view of the rear side of a carrier bag of the present disclosure.

FIG. 1 shows a rear side view of a carrier bag 2 having a first side panel 4 with a first carrier handle 6 that is a first flexible loop and an opposing second side panel 8 with a second carrier handle 10 that is a second flexible loop. It has to be emphasized that although the carrier handles 6 and 10 are shown in a slightly displaced position this usually is not the case. Usually first carrier handle 6 more or less fully covers second carrier handle 10 in a rear side view, whereas second carrier handle 10 usually fully covers first carrier handle 6 in a front side view of bag 2, i.e., said carrier handles are arranged opposing each other. The carrier handles have been shown in FIGS. 1, 2, and 3 in a slightly displaced orientation merely for the sake of showing both carrier handles in a single figure.

The first side panel 4 has a first upper edge 12 and a first lower edge 14 as well as two first side edges 20, 22. The second side panel 8 has a second upper edge 16 and a second lower edge 18 as well as two second side edges 24, 26 (not shown in FIG. 1, cf. FIG. 2). In this particular embodiment, the bottom 28 of the bag 2 is formed by a bottom wall 30 (not shown in FIG. 1, cf. FIG. 4) that is connected to the first and second lower edges 14, 18. An opening 34 is formed between the first and second upper edges 12, 16. The first upper edge 12 extends between the two first side edges 20, 22 at a first distance D1 from the first lower edge 14 and the second upper edge 16 extends between the two second side edges 24, 26 at a second distance D2 from the second lower edge (not shown in FIG. 1, adjacent to first lower edge 14, cf. FIG. 2). The first distance D1 is smaller than the second distance D2 and the first upper edge 12 is displaced by a third distance D3 from the second upper edge 16. The third distance D3 equals the difference between first and second distances D1, D2. When bags are used by customers to put items such as food articles into said bags at a service station, the steps usually necessary to use the bags include grabbing a bag, opening said bag, and inserting the item. In order to provide bags in an orderly fashion, stacks of packs are often stored in a rack for bags. One major issue is to separate a bag from the other bags and additionally to open said bag, minimizing both the involved time and work. The aforementioned carrier bag 2 has a first upper edge 12 and a second upper edge 16 that are spaced apart from each other. This enables a user to easily and selectively grab a specific edge, i.e., the second upper edge 16 that is further away from the bottom 28 of the bag (the edge that is higher). As only one edge is grabbed, the bag 2 may be separated from other similarly built carrier bags and simultaneously opened easily (cf. FIG. 5).

In this particular embodiment, first and second side panels 4, 8 are connected to each other by a first weld seam 36 at one of the two first side edges 20 of the first side panel 4 and at one of the two second side edges 26 (not shown in FIG. 1, cf. FIG. 2) of the second side panel 8 to form a left lateral side of the bag. Similarly, the first and second side panels 4, 8 are connected to each other by the second weld seam 38 at the other one of the two first side edges 22 of the first side panel 4 and at the other one of the two second side edges 24 (not shown in FIG. 1, cf. FIG. 2) of the second side panel 8 to form a right lateral side of the bag. Said first and second weld seams 36 and 38 also each connect the bottom wall (not shown in FIG. 1, cf. FIG. 4) with the first and second side panels 4, 8. In order to connect the first and second side panels 4, 8 using the first and second weld seams 36 and 38 at the edges, it is not necessary to weld the edges themselves. Instead a weld line in close proximity to the actual edges can be used. In the present example, the distance between weld seams 36 and 38 and their corresponding edges is less than 2.0 cm. The separation of the first and second side panels 4, 8 using the first and second upper edges 12, 16 works well even if first and second weld seams 36, 38 connect the first and second panel 4, 8 adjacent to the opening 34 directly (resulting in a close arrangement of the first upper edge to the second side panel 8). Although the opening would be larger if side gussets were used, it has been found that the embodiment as shown in FIG. 1 still allows for an easy separation of the second side panel 8 from a stack of bags. The first upper edge 12 is typically longer than each of the two first side edges 20, 22.

Figure 2:
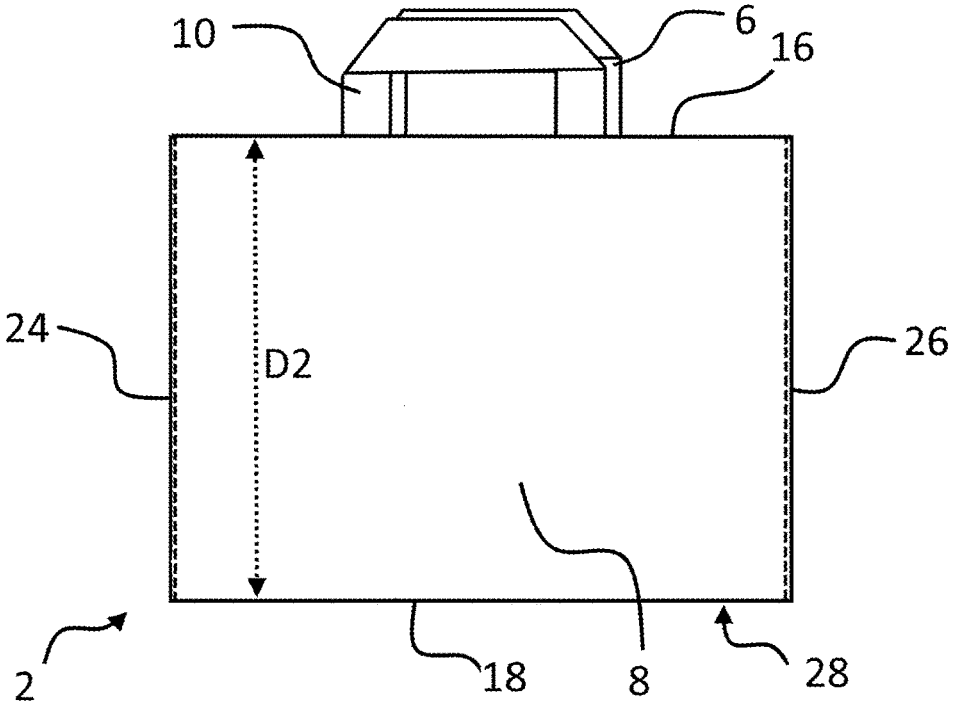
FIG. 2 is a plan view of the front side of the carrier bag in FIG. 1.

FIG. 2 shows a front side view of the carrier bag 2 having a second side panel 8 with a second carrier handle 10 that is a second flexible loop and an opposing first side panel 4 (not shown in FIG. 2, cf. FIGS. 1 and 3) with a first carrier handle 6 that is a first flexible loop. The second side panel 8 has a second upper edge 16 and a second lower edge 18 as well as two second side edges 24, 26. The first and second side panels 4, 8 are connected to each other at the first and second side edges 20, 22, 24, 26 to form left and right lateral sides of the bag (cf. FIGS. 1 and 2). The bottom 28 of the bag is formed by a bottom wall (not shown in FIG. 2, cf. FIG. 4) that is connected to the first and second lower edges 14, 18. The second upper edge 16 extends between the two second side edges 24, 26 at a second distance D2 from the second lower edge 18.

Figure 3:
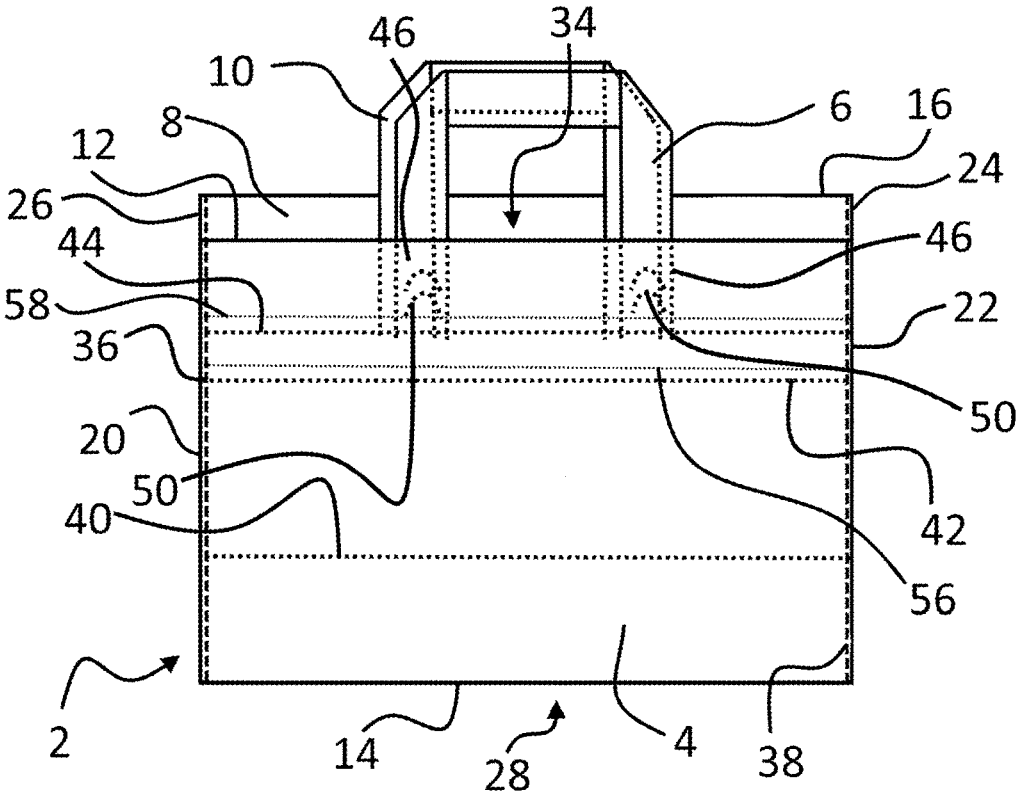
FIG. 3 is a plan view of the rear side of the carrier bag in FIG. 1 wherein sections that are not visible have been indicated using dotted lines.

FIG. 3 shows the rear side view of a carrier bag 2 having a first side panel 4 with a first carrier handle 6 and a second side panel 8 with a second carrier handle 10. The first side panel 4 has a first upper edge 12 and a first lower edge 14 as well as two first side edges 20, 22. The second side panel 8 has a second upper edge 16 and a second lower edge as well as two second side edges 24, 26 (cf. also FIG. 2). The first and second side panels 4, 8 are connected to each other at the first and second side edges 20, 22, 24, 26 by first and second weld seams 36, 38. The bottom 28 and opening 34 of the bag are shown. Furthermore, FIG. 3 shows sections that cannot be derived from FIG. 1 as said sections are covered by the first side panel 4 and its first carrier handle 6. Said sections are indicated with dotted lines. FIG. 3 shows a fold line 40 of the bottom wall 30 (bottom wall 30 not shown in FIG. 3, cf. FIG. 4). FIG. 3 also shows a lower rim 42 of a first foil strip. Said first foil strip is circumscribed by the lower rim 42, the first upper edge 12 as well as the first side edges 20 and 22. The first foil strip is attached to first side panel 4 by a third weld seam 56. Thus the circumscribed region of the first foil strip contains a sealed compartment, preferably i.e. essentially air tight sealed in all directions. This is particularly advantageous for the stability of the circumscribed region. The sealed compartment preferably contains very little air or other gas. It has been found that this surprisingly strongly influences the stability. Due to the fact that the circumscribed region contains a compartment that is sealed and that contains little gas between the first side panel 4 and the first foil strip, said side panel 4 and the first foil strip are firmly attached to each other within the circumscribed region. Removing the first foil strip in a section within the region of the sealed compartment, circumscribed by the third weld seam 56, the first upper edge 12 as well as the first and second weld seams 36, 38, would require that atmospheric pressure is overcome. This arrangement results in a particularly non-yielding area that may be used to firmly secure the first carrier handle 6. Similarly a second foil strip is circumscribed by a lower rim 44, the second upper edge 16 as well as the second side edges 24 and 26 (said second side edges are partially covered by first side edges 20, 22). In this case, a sealed compartment with little enclosed gas is created using a fourth weld seam 58 close to the lower rim 44 as well as first and second weld seams 36, 38. Said sealed compartment thus also results in a non-yielding area that may be used to firmly secure the second carrier handle 10.

In FIG. 3, it is also shown that the total length of the first carrier handle 6 includes sections 46 that extend downward from the first upper edge 12. The first carrier handle 6 has a first total length and a first partial length, wherein the first partial length is the length that extends beyond the first upper edge 12 away from the first lower edge 14. The second carrier handle 10 similarly has a second total length and a second partial length, wherein the second partial length is the length that extends beyond the second upper edge 16 away from the second lower edge 18 (not shown in FIG. 3, cf. FIG. 2). The total length of first and second carrier handles 6 and 10 does not differ. However, the partial length is different. The first carrier handle 6 offers a greater access opening for the hand of the customer than the second carrier handle 10. The difference in the size of openings appears disadvantageous at a first glance (there is just one ideal size for the access opening of a hand). However, it was found that this disadvantage is overcome by the increase in stability due to the fact that both carrier handles 6, 10 are strained to a similar extent when an item is carried. Furthermore, the bag 2 is kept in a balanced position using the carrier handles 6, 10 as described above. As shown in FIG. 3, the first carrier handle 6 is attached by four first welding or gluing areas 50 to the first side panel 4. The second carrier handle 10 is similarly attached by four second welding or gluing areas (not shown in FIG. 3) to the second side panel 8. A person skilled in the art will appreciate that more weld seams to attach the handles are also possible.

Figure 4:
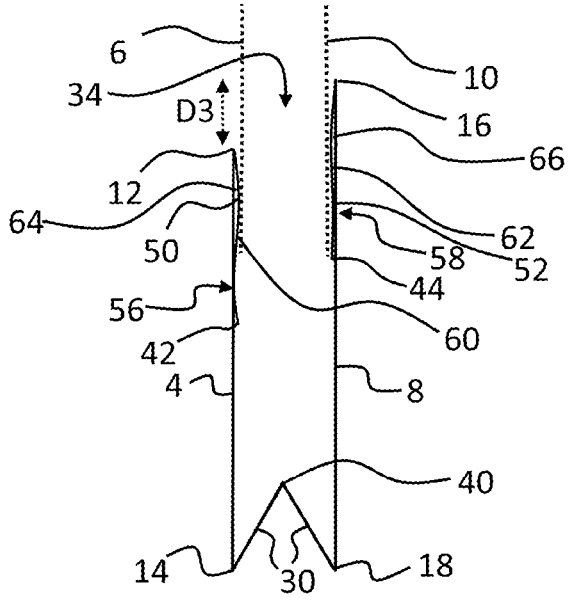
FIG. 4 is a cross sectional view of the carrier bag in FIG. 1.

FIG. 4 is a cross sectional view of the carrier bag in FIG. 1. A first side panel 4 with a first carrier handle 6 and a second side panel 8 with a second carrier handle 10 is shown. Between the first and second side panels 4, 8 there is an opening 34. The position of the carrier handles is only indicated with dotted lines. The first upper edge 12 is formed by a first V-shaped fold, wherein one thigh of the first V-shaped fold is formed by the first side panel 4 whereas the other thigh is formed by a first foil strip 60 that is connected to the first side panel using a third weld seam 56 and is facing the second side panel 8. The second upper edge 16 is formed by a second V-shaped fold, wherein one thigh of the second V-shaped fold is formed by the second side panel 8 whereas the other thigh is formed by a second foil strip 62 that is connected to the second side panel 8 using a fourth weld 58 seam and is facing the first side panel 4. The first foil strip 60 is circumscribed by the lower rim 42, the first upper edge 12 as well as the first side edges 20 and 22. A sealed compartment 64 is circumscribed by the third weld seam 56, the first upper edge 12 as well as the first side edges 20 and 22 (not shown in FIG. 4, cf. FIG. 1). Advantages of said sealed compartment 64 have been discussed above. For the sake of clarity, the drawing depicts a thin space between the first foil strip 60 and first side panel 4. However, it is actually preferred that said sealed compartment 64 contains almost none to no gas. In this case, the first foil strip 60 and first side panel 4 are adjacent in the region of the sealed compartment 64 without any space in between. Similarly, the second foil strip 62 is circumscribed by the lower rim 44, the second upper edge 16 as well as the second side edges 24 and 26 (not shown in FIG. 4, cf. FIG. 2). A sealed compartment 66 is circumscribed by the fourth weld seam 58, the second upper edge 16 as well as the second side edges 24 and 26. Advantages of said sealed compartment 66 have been discussed above. For the sake of clarity, the drawing depicts a thin space between the second foil strip 62 and second side panel 8. However, it is again preferred that said sealed compartment 66 contains almost none to no gas. In this case, the second foil strip 62 and the second side panel 8 are adjacent in the region of the sealed compartment 66 without any space in between. A bottom of the bag is formed by a bottom wall 30 that is connected to the first and second lower edges 14, 18. In this particular embodiment, bottom wall 30 comprises a V-shaped fold line 40.

The first flexible loop 6 is connected to the first foil strip 60 and the second flexible loop 10 is connected to the second foil strip 62 using first and second welding or gluing areas 50, 52 (in FIG. 4 only positions of said weld seams are indicated, cf. FIG. 3) and third and fourth weld seams 56, 58 connect the first foil strip 60 to the first side panel 4 and the second foil strip 62 to the second side panel 8. Four first welding or gluing areas 50 (cf. FIG. 3) are arranged opposing to four second welding or gluing areas 52 and said four first welding or gluing areas 50 are arranged at a fourth distance from the first lower edge 14 and the four second welding or gluing areas 52 are arranged at a fifth distance from the second lower edge 18, wherein the fourth distance is equal to the fifth distance. The first carrier handle 6 is attached by the first welding or gluing areas 50 to the first foil strip 60 at a sixth distance from the first upper edge 12 and the second carrier handle 10 is attached to the second foil strip 62 by the second welding or gluing areas 52 at a seventh distance from the second upper edge 16, wherein the seventh distance is larger than the sixth distance.

Figure 5:
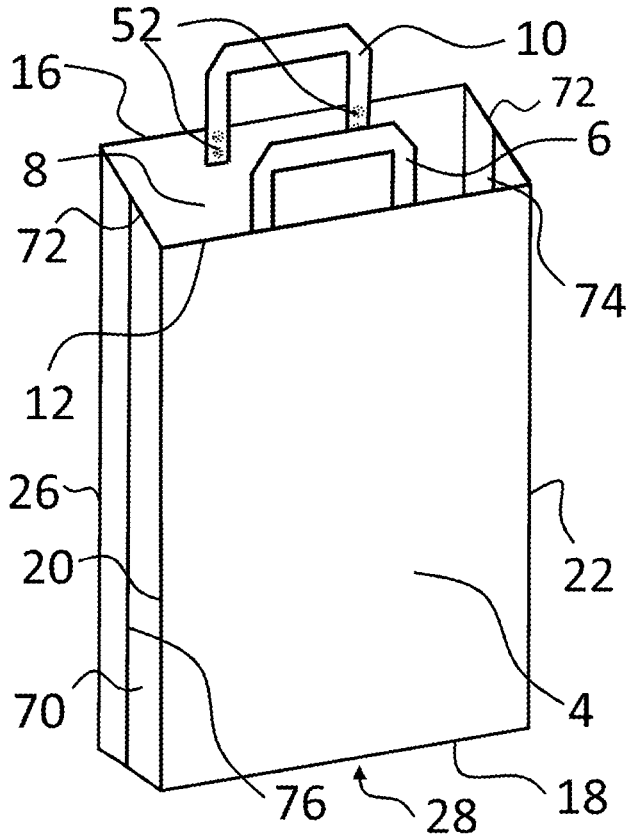
FIG. 5 is a perspective view of another embodiment of a carrier bag according to the present disclosure.

FIG. 5 shows another embodiment of a bag according to the present disclosure. In FIGS. 1 to 4, the bag is formed by connecting the first and second edges to form lateral sides of the bag. In FIG. 5, the first and second side edges 20, 22, 24, 26 are connected to opposing lateral walls 70, 74. The lateral wall 70 will be discussed in more detail. Said wall may contain side gussets, and a folding line 76 is shown. Said folding line may be part of or adjacent to a connection area in which different sections of each of the lateral walls are glued or welded together. The upper rim 72 of said lateral wall 70 is arranged between the first and second upper edges 12, 16 of the first and second side panels 4, 8. In the present example, the upper rim 72 is formed continuously. However, it is also possible to use a discontinuous upper rim 72 for the lateral wall 70. To the second side panel 8 the second carrier handle 10 is connected. Said carrier handle is fastened to the second side panel using fastening means 52 (in this case welding or gluing areas). Similarly the first side panel 4, having first side edges 20, 22 is connected to the first carrier handle 6.

Figure 6:
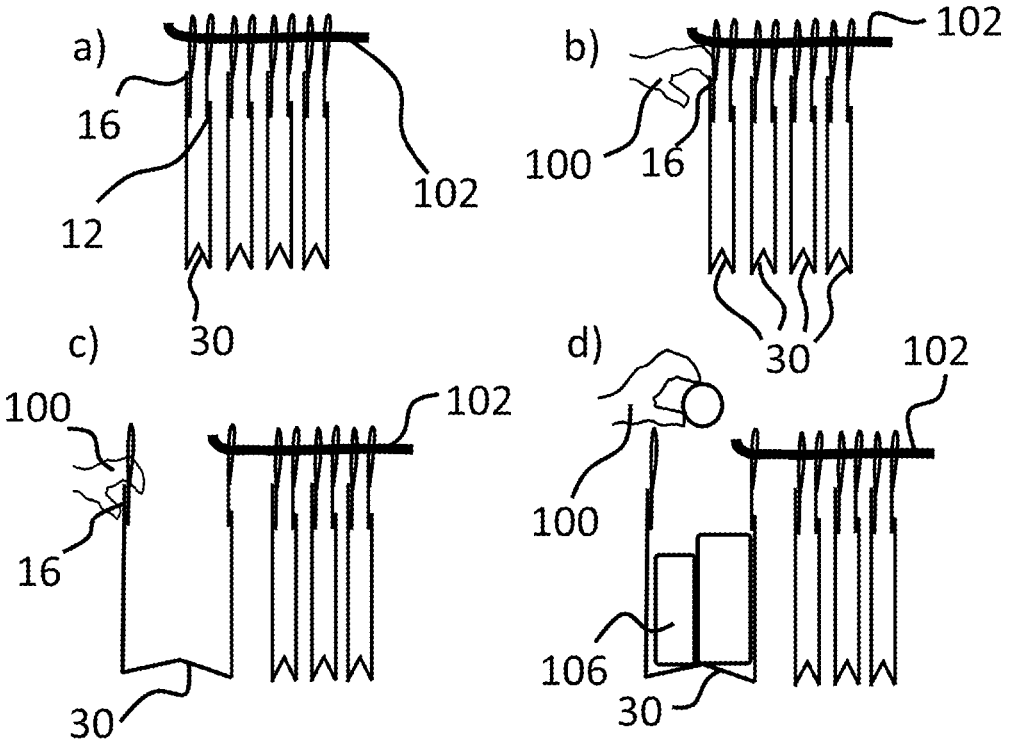
FIG. 6 illustrates how the bag according to FIG. 1 may be used by a customer.

FIG. 6 shows the serial dispensing and opening of a bag according to the present disclosure from a rack for multiple bags. In step a), a rack of bags is shown. Said rack comprises a mount 102 for bags. Each bag has a second upper edge 16 on the front side and a first upper edge 12 on the backside that is closer to the lower portion of the bag. Each bag comprises a folded bottom wall 30. In step b), a customer grabs the bag by gripping the rim with the second edge 16 with one hand 100. In step c), the bag is unfolded and ready to be filled. In step d), the bag is filled with items 106.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

Figure 7:
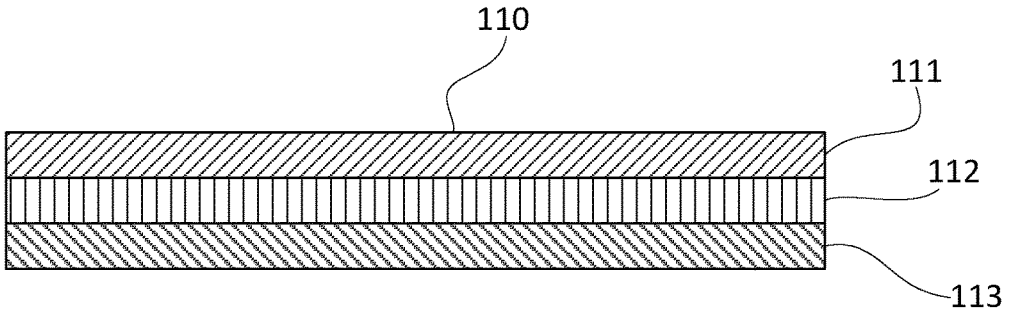
FIG. 7 illustrates an enlarged cross-sectional view of a portion of a carrier handle according to the present disclosure.

FIG. 7 shows a cross-sectional view of a portion of a carrier handle 110 comprised of at least two layers of plastic foil 111 and 112. In the illustrated embodiment, layers 111 and 112 comprise or are made from different thermoplastic polymers. As described earlier, in at least one embodiment, the layers of each carrier handle 110 that are facing each other are made of or comprise polypropylene whereas the adjacent layers preferably comprise or are made of polyethylene. The carrier handle 110, in particular on one side of a plastic foil of the carrier handle, is at least partially coated with lacquer 113 in such a way that welding of first and second carrier handles in said coated areas is inhibited.

These and other changes can be made to the embodiments in light of the above-detailed description. In general, in the following claims, the terms used should not be construed to limit the claims to the specific embodiments disclosed in the specification, but should be construed to include all possible embodiments along with the full scope of equivalents to which such claims are entitled. Accordingly, the claims are not limited by the disclosure.

What is claimed is:

1. A carrier bag, comprising:

a first side panel with a first carrier handle, and an opposing second side panel with a second carrier handle, wherein the first side panel has a first upper edge and a first lower edge as well as two opposite first side edges, wherein the second side panel has a second upper edge and a second lower edge as well as two opposite second side edges, wherein the first and second side panels are connected to each other at or adjacent to the respective first and second side edges to form lateral sides of the bag or wherein the first and second side panels are connected at the first and second side edges to opposing lateral walls to form lateral sides of the bag, wherein a bottom of the bag is formed by a bottom wall that is connected to the first and second lower edges or by a weld seam that joins the first and second lower edges, wherein an opening is formed between the first and second upper edges, wherein the first upper edge has a first distance from the first lower edge and the second upper edge has a second distance from the second lower edge, wherein the first distance is smaller than the second distance, wherein the first upper edge is displaced by a third distance from the second upper edge, the third distance equaling the difference between the first and second distances, wherein the second upper edge is formed by a V-shaped fold, wherein one thigh of the V-shaped fold is formed by the second side panel whereas the other thigh is formed by a foil strip that is connected to the second side panel using a weld seam spaced at a distance from the V-shaped fold, and wherein a sealed compartment is circumscribed by the weld seam spaced at a distance from the V-shaped fold, the second upper edge, and the second side edges resulting in a non-yielding area that is used to secure the second carrier handle to the carrier bag.

2. The bag of claim 1 wherein the first and second side panels are connected to each other at or adjacent to the first and second side edges to form lateral sides of the bag, and wherein the bottom of the bag is formed by the bottom wall that is connected to the first and second lower edges.

3. The bag of claim 2 wherein the first and second side panels are connected to each other by first and second weld seams or glue seams at the first and second side edges to form lateral sides of the bag, and wherein the bottom of the bag is formed by the bottom wall that is connected to the first and second lower edges and the first and second weld seams or glue seams also each connect said bottom wall with the first and second side panels.

4. The bag of claim 3 wherein the bottom wall forms a W-shaped fold in combination with the first and second side panels.

5. The bag of claim 1 wherein the V-shaped fold forming the second upper edge is second V-shaped fold, and the foil strip forming the other thigh of the second V-shaped fold is second foil strip, and wherein the first upper edge is formed by a first V-shaped fold, wherein one thigh of the first V-shaped fold is formed by the first side panel whereas the other thigh is formed by a first foil strip that is connected to the first side panel using a weld seam spaced at a distance from the first V-shaped fold.

6. The bag of claim 5 wherein the first carrier handle is connected to the first foil strip and the second carrier handle is connected to the second foil strip using first and second welding or gluing areas.

7. The bag according to claim 5 wherein the first side panel, second side panel, first foil strip, second foil strip and bottom wall are different sections of a continuous foil that is formed in one piece, wherein said sections are separated by folds, wherein there are first and second weld seams or glue seams that respectively connect the first foil strip and the bottom wall to the first side panel as well as the second foil strip and the bottom wall to the second side panel.

8. The bag of claim 5 wherein the first carrier handle is attached to the first foil strip at a distance from the first upper edge and the second carrier handle is attached to the second foil strip at a different distance from the second upper edge, wherein said different distance is larger than the distance of the first carrier handle from the first upper edge.

9. The bag of claim 5 wherein the first side panel and the first foil strip enclose the sealed compartment void of air or any other gas and/or experiencing underpressure.

10. The bag according to claim 1 wherein the first carrier handle is attached by at least four first fastening means comprised of at least four first welding or gluing areas to the first side panel, and the second carrier handle is attached by at least four second fastening means comprised of at least four second welding or gluing areas to the second side panel.

11. The bag according to claim 10 wherein the at least four first fastening means are arranged opposing to the at least four second fastening means and/or wherein the at least four first fastening means are arranged at a fourth distance from the first lower edge and the at least four second fastening means are arranged at a fifth distance from the second lower edge, wherein the fourth distance is equal to the fifth distance.

12. The bag according to claim 1 wherein the first and second panels are made from a first type of plastic foil and the first and second carrier handles are made from a second type of plastic foil, and/or wherein the first and second carrier handles each are made of multiple layers of plastic foil, resulting in a multi-layered first and second composite carrier foil.

13. The bag according to claim 12 wherein the first and second carrier handles each comprise at least two layers, wherein said layers comprise or are made from different thermoplastic polymers wherein the layers of each carrier handle that are facing each other are made of or comprise polypropylene whereas adjacent layers preferably comprise or are made of polyethylene, and/or wherein the first and second carrier handles are at least partially coated with lacquer, on one side of a plastic foil, in such a way that welding of the first and second carrier handle in coated areas is inhibited.

14. The bag of claim 1 wherein the first carrier handle has a first total length and a first partial length, wherein the first partial length is the length that extends beyond the first upper edge away from the first lower edge, wherein the second carrier handle has a second total length and a second partial length, wherein the second partial length is the length that extends beyond the second upper edge away from the second lower edge, wherein the first and second total lengths are equal and/or wherein the first partial length is greater than the second partial length.

15. The bag of claim 1 wherein the first and second upper edge are spaced apart from each other at the third distance, wherein the third distance is at least 0.20 inch or 5 mm.

16. The bag of claim 1 wherein the first upper edge is longer than each of the two first side edges.

17. The bag of claim 1 wherein the carrier bag has at least six layers of foil in a section of the carrier handle.

18. A rack of bags comprising bags according to claim 1 wherein the rack comprises at least one mount for said bags and wherein said bags are not connected to each other, but placed adjacent to each other.

19. The bag of claim 1, wherein the first carrier handle is a first flexible loop, and the second carrier handle is a second flexible loop.

20. The bag of claim 1, wherein the second side panel is comprised of a sheet of material that is solid from the second upper edge to the second lower edge and between the two opposite second side edges.

21. A method for producing a carrier bag having:

a first side panel with a first carrier handle, and an opposing second side panel with a second carrier handle, wherein the first side panel has a first upper edge and a first lower edge as well as two opposite first side edges, wherein the second side panel has a second upper edge and a second lower edge as well as two opposite second side edges, wherein the first and second side panels are connected to each other at or adjacent to the respective first and second side edges to form lateral sides of the bag or wherein the first and second side panels are connected at the first and second side edges to opposing lateral walls to form lateral sides of the bag, wherein a bottom of the bag is formed by a bottom wall that is connected to the first and second lower edges or by a weld seam that joins the first and second lower edges, wherein an opening is formed between the first and second upper edges, wherein the first upper edge of the first side panel extends between the two first side edges at a first distance from the first lower edge of the first side panel and the second upper edge of the second side panel extends between the two second side edges at a second distance from the second lower edge of the second side panel, wherein the first distance is smaller than the second distance and wherein the first upper edge is displaced by a third distance from the second upper edge, the third distance equaling the difference between the first and second distances, wherein the second upper edge is formed by a V-shaped fold, wherein one thigh of the V-shaped fold is formed by the second side panel whereas the other thigh is formed by a foil strip that is connected to the second side panel using a weld seam spaced at a distance from the V-shaped fold, wherein a sealed compartment is circumscribed by the weld seam spaced at a distance from the first V-shaped fold, the second upper edge, and the second side edges resulting in a non-yielding area that is used to secure the second carrier handle to the carrier bag, wherein the method of producing said carrier bag comprises the following steps in this or a deviating order:

aligning the first and second side panels in such a way adjacent to each other that the first and second upper edges are arranged at a distance from each other, inserting the first and second carrier handle between the first and second side panels, and welding the first carrier handle to the first side panel and the second carrier handle to the second side panel in a single welding step.

22. A process of serially dispensing and opening a bag, from a stack of said bags, wherein each bag comprises:

a first side panel with a first carrier handle, and an opposing second side panel with a second carrier handle, wherein the first side panel has a first upper edge and a first lower edge as well as two opposite first side edges, wherein the second side panel has a second upper edge and a second lower edge as well as two opposite second side edges, wherein the first and second side panels are connected to each other at or adjacent to the respective first and second side edges to form lateral sides of the hag or wherein the first and second side panels are connected at the first and second side edges to opposing lateral walls to form lateral sides of the bag, wherein a bottom of the bag is formed by a bottom wall that is connected to the first and second lower edges or by a weld seam that joins the first and second lower edges, wherein an opening is formed between the first and second upper edges, wherein the first upper edge of the first side panel extends between the two first side edges at a first distance from a first lower edge of the first side panel, and a second upper edge of the second side panel extends between two second side edges at a second distance from a second lower edge of the second side panel, wherein the first distance is smaller than the second distance and wherein the first upper edge is displaced by a third distance from the second upper edge, the third distance equaling the difference between the first and second distances, wherein the second upper edge is formed by a V-shaped fold, wherein one thigh of the V-shaped fold is formed by the second side panel whereas the other thigh is formed by a foil strip that is connected to the second side panel using a weld seam spaced at a distance from the V-shaped fold, wherein a sealed compartment is circumscribed by the weld seam spaced at a distance from the first V-shaped fold, the second upper edge, and the second side edges resulting in a non-yielding area that is used to secure the second carrier handle to the carrier bag, wherein the bags are arranged in a rack for bags having at least one mount for bags and wherein said bags are placed adjacent to each other, wherein the carrier handles are arranged on said at least one mount, and wherein the process of serially dispensing and opening a bag comprises:

grabbing the topmost bag at the second upper edge and pulling on said second upper edge, unfolding the topmost bag while the first upper edge is kept adjacent to the remaining stack of bags, inserting items into the topmost bag, and grabbing the topmost bag at the first and second upper edge and/or the first and second carrier handles in order to remove said bag from the remaining stack of bags.

* * * * *